United States Patent [19]

Brown

[11] 4,429,665

[45] Feb. 7, 1984

[54] FUEL TREATING DEVICE AND METHOD

[76] Inventor: Bill H. Brown, 3933 Boise Crt., Irving, Tex. 75062

[21] Appl. No.: 408,756

[22] Filed: Aug. 17, 1982

[51] Int. Cl.[3] ..... F02M 27/00

[52] U.S. Cl. ..... 123/3; 208/134; 123/1 A

[58] Field of Search ..... 123/3, 1 A, 538; 208/134, 295

[56] References Cited

U.S. PATENT DOCUMENTS

| | | | |
|---|---|---|---|
| 1,376,180 | 4/1921 | Wickersham | 123/538 |
| 1,826,144 | 10/1931 | Lachman | 208/295 |
| 1,913,940 | 6/1933 | Mittasch et al. | 208/134 |
| 3,116,726 | 1/1964 | Kwartz | 123/538 |
| 3,597,668 | 8/1971 | Yoshimine | 123/538 |
| 3,717,129 | 2/1973 | Fox | 123/1 A |
| 4,050,426 | 9/1977 | Sanderson | 210/222 |
| 4,073,273 | 2/1978 | McMahon | 123/538 |
| 4,088,450 | 5/1978 | Kosaka et al. | 123/3 |
| 4,256,060 | 3/1981 | Kelly | 123/3 |

*Primary Examiner*—William A. Cuchlinski, Jr.

*Attorney, Agent, or Firm*—Charles D. Gunter, Jr.

[57] ABSTRACT

A device and method for improving the combustion characteristics of liquid fuels is shown. The device has an elongated casing with a hollow interior and inlet and outlet ports which are inserted in the fuel line of the fuel to be treated. An elongated metal bar is placed within the casing so that the exterior surfaces of the bar contact the fuel flowing within the casing. The metal bar is an alloy made of nickel, zinc, copper, tin, and silver which is generally triangular in cross-sectional area and substantially occupies the interior of the casing. Spaced-apart elevated ridges in the exterior surfaces of the metal bar promote turbulent flow in the fuel passing through the casing and over the surfaces of the metal bar.

8 Claims, 3 Drawing Figures

FUEL TREATING DEVICE AND METHOD

BACKGROUND OF THE INVENTION

This invention relates to a device and method for treating liquid fuels, including gasoline and diesel fuel, to improve the combustion characteristics of the fuels in internal combustion engines.

The subject of energy conservation is currently attracting great attention, especially in the areas of petroleum and petroleum-based fuels. The automobile is one of the chief consumers of petroleum in the form of gasoline and significant conservation of energy could be achieved by improving the combustion process in the internal combustion engine. Thus, a great deal of effort is now being directed to achieve a greater amount of work from the automobile engine for an equal amount of fuel consumed. A desirable by-product of more efficient combustion is that engine exhaust emissions are generally cleaner since the fuel is more completely burned.

Various attempts in the past to improve the combustion characteristics of fuel involved applying electrostatic fields across the fuel as it flowed to the combustion chamber. In U.S. Pat. No. 1,376,180 to Wickersham, issued Apr. 26, 1921, the fuel is subjected to the action of an electric spark passing between electrodes. In U.S. Pat. No. 3,116,726 to Kwartz, issued Jan. 7, 1964, a coil mounted next to the fuel line creates a high intensity magnetic field which affects the combustion characteristics of the fuel. U.S. Pat. No. 4,073,273 to McMahon, issued Feb. 14, 1978 teaches the use of an electrostatic field applied across the fuel line to produce a measurable alteration in hydrocarbon composition of the fuel making it less susceptible to detonation. U.S. Pat. No. 4,050,426 to Sanderson, issued Sept. 27, 1977, shows a device including a magnetic chamber placed in the fuel line with the fuel flowing over a sheathed magnetic material. U.S. Pat. No. 3,597,668 to Yoshimine, issued Aug. 3, 1971, describes a static charger for electrostatically charging fuel going to the carburetor of an automobile. The device includes a friction element which is made up of a sheet or mesh coated with a semiconductor film.

The mechanism by which such devices work is not fully understood. One theory advanced is that when charged fuel evaporates, electrically charged particles having the same polarity are electrically repulsed from one another, thus increasing the rate of vaporization of the fuel. Another theory is that the alkyl and alkene chains making up hydrocarbon fuels are initially distributed in an asymmetric nonpolar pattern. Minute impurities having a polar makeup are present in the fuel as it comes from the refinery or are introduced during transportation and storage. By redistributing the molecular pattern of the impurities in the fuel through the application of an electrostatic charge, more efficient and complete combustion is achieved.

By whatever theory, such devices in operation have been shown to alter the combustion characteristics of fuel.

SUMMARY OF THE INVENTION

The device for treating liquid fuels of the present invention has an elongated casing with a hollow interior and inlet and outlet ports for receiving and discharging fuel. An elongated metal bar of generally triangular cross-sectional area is located within and substantially occupies the hollow interior of the casing. Spaced-apart ridges in the bar's exterior surfaces promote turbulence in the fuel flowing through the casing. The elongated metal bar is an alloy comprising 10–30 weight percent nickel, 15–40 weight percent zinc, 30–60 weight percent copper, 5–2 weight percent tin, and 1–10 weight percent silver, all weight percentages being based on the total weight of alloy present. Preferably the alloy is 21 weight percent nickel, 25 weight percent zinc, 42 weight percent copper, 10 weight percent tin and 2 weight percent silver. A platinum coating is preferably applied on either end of the elongated metal bar.

A method of making the metal alloy includes heating together in a suitable container 30–60 weight percent copper, 5–20 weight percent tin, and 1–10 weight percent silver, all percentages based on the weight of total alloy, to form a molten mass. The temperature of the container is in the range of 1800°–2100° F. The container is then heated in the range of 2600°–2800° F. and 10–30 weight percent nickel is added to the molten mass. The container is then heated in the range of 3200°–3400° F. and 15–40 weight percent zinc is added to the molten mass. After approximately 5 minutes, the molten mass is poured into a mold and allowed to solidify into the shape of an elongated bar.

In the method of treating fuel using the device of the present invention, liquid fuel is treated prior to being mixed with an oxygen containing gas and ignited. The fuel flows through the hollow interior of the casing housing the elongated metal bar, contacting the exterior surfaces of the elongated metal bar and producing improved combustion characteristics in the fuel so treated.

Additional objects, features and advantages of the invention will become apparent in the following descriptions.

DETAILED DESCRIPTION OF THE INVENTION

Figure 1:
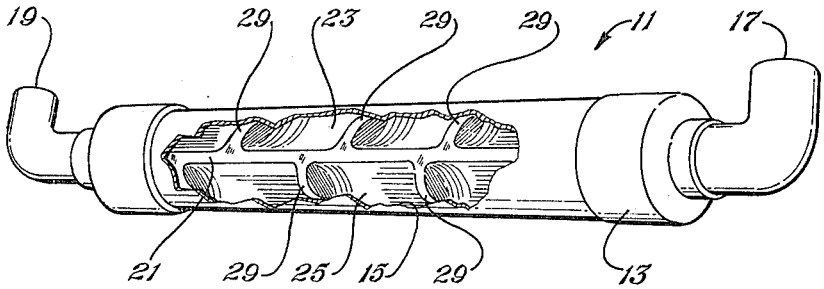
FIG. 1 is a perspective side view of a device of the present invention shown partially broken away.

Referring now to FIG. 1, there is shown a device of the present invention designated generally as 11. The device includes an elongated casing 13, preferably made of copper. As the casing material does not contribute to the operation of the device, such materials as stainless steel or even rubber can be used as well. The casing 13 has a hollow interior 15, an inlet port 17 for receiving fuel, and an outlet port 19 for discharging fuel. The casing 13 can conveniently be inserted in the fuel line of an automobile between the gas tank and carburetor. Preferably, the casing 13 is inserted at a point near the gas tank.

Figure 2:
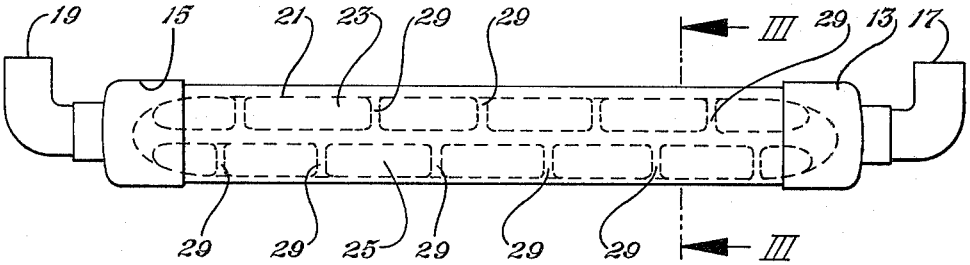
FIG. 2 is a schematic representation of the device of FIG. 1 showing the placement of the metal bar in the casing.
Figure 3:
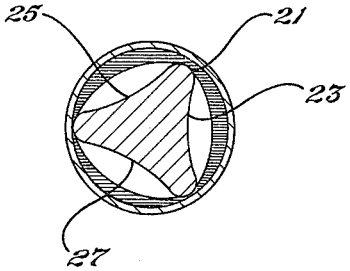
FIG. 3 is a cross-sectional view of the device of FIG. 2, taken along the lines III—III.

Inside the casing 13 is an elongated metal bar 21 which substantially occupies the hollow interior 15 of casing 13 as shown in FIG. 2. The metal bar 21 has exterior surfaces 23, 25, and 27 which contact fuel flowing through the casing 13 as fuel is received and discharged through ports 17 and 19. The exterior surfaces 23, 25, and 27 of metal bar 21 have spaced-apart ridges 29 in order to promote turbulence in the fuel flowing over the metal bar 21 inside casing 13.

Metal bar 21 is a special alloy comprising nickel, zinc, copper, tin, and silver. The metals used in practicing the present invention are all commercially available.

The nickel used was obtained from Miller & Company of Chicago, Ill., and is of 91% to 92% purity. Nickel is preferably present in the alloy in the range of 10–30 weight percent based on the total weight of alloy, with 21 weight percent being most preferred.

The tin used in practicing the invention was obtained from Miller & Company of Chicago, Ill., as "tin shot" of 99.9% purity. Tin is preferably present in the alloy in the range of 5–20 weight percent based on the weight of total alloy, with 10 weight percent tin being most preferred.

The silver used in making the alloy of the present invention was 90% pure. Silver is preferably present in the alloy in the range of 1–10 weight percent based on the weight of total alloy, with 2 weight percent silver being most preferred.

The zinc used in making the alloy was obtained in 50 pound ingots of 99.9% purity. Zinc is preferably used in the range of 15–40 weight percent based on the weight of total alloy, with 25 weight percent being most preferred.

The copper used was high electrolytic copper available commercially as #1 wiring copper and the like. Copper is present in the alloy in the range of 30–60 weight percent based on the weight of total alloy, with 42 weight percent being most preferred.

The method of making an alloy of the type under consideration can be best illustrated with reference to the following example:

EXAMPLE I

Approximately 42 weight percent copper, 10 weight percent tin, and 2 weight percent silver, all percentages based on the weight of total alloy, are heated in a graphite container in a furnace to form a molten mass. The container is heated in the range of 1800°–2100° F. After the metals have all reached the liquid state, the container is further heated in the range of 2600°–2800° F. Next, approximately 21 weight percent nickel based on the weight of total alloy is added to the molten mass and melted. When all of the nickel has been taken into solution, the container is further heated to 3200°–3400° F. At this time, approximately 25 weight percent zinc based on the weight of total alloy is added to the molten mass in the container. As zinc melts at about 790° F. and boils at about 1665° F., it must be added with great care in order to avoid a violent reaction. Adding the zinc earlier in the process would result in much of the material being driven off as a gas, however. After approximately 5 minutes, the container is removed from the furnace and the molten mass contained therein is poured into a mold of clay-bonded foundry sand.

The mold is shaped to produce a series of elongated bars of generally triangular cross-sectional area which can be broken out upon solidifying and used in practicing the present invention. The bars used for automobile fuel lines are about 4 to 6 inches long and ¼ to ½ inch thick. Preferably the bars are coated on each end with a thin layer of platinum. This is accomplished by heating a small amount of platinum in a 1 ounce crucible with an acetylene torch. When the platinum becomes liquid, the ends of the bar are dipped in turn into the molten platinum and quickly removed, allowing a thin coating of platinum to form.

In practicing the present invention, the metal bar 21 (FIG. 1) is first placed inside copper casing 13. The ends of casing 13 are sealed except for inlet port 17 and outlet port 19 which are inserted in the fuel line of an internal combustion engine of the type wherein liquid fuel and an oxygen containing gas are first mixed and then ignited. The fuel in the fuel line flows into port 17 and over the external surfaces 23, 25, and 27 of metal bar 21. The spaced-apart elongated ridges 29 in the exterior surfaces of metal bar 21 promote turbulence in the fuel flowing over the bar and insure greater contact between the bar 21 and fuel being treated. The treated fuel passes out port 19 and continues on to the air-fuel mixer. Best results are achieved if the device 11 is installed near the fuel tank at a point remote from the air-fuel mixing point.

An invention has been provided with significant advantages. The present device for treating fuels produces a more efficient rate of combustion in internal combustion engines resulting in greater fuel economy. Fuels are more completely combusted in the engine resulting in decreased hydrocarbon emissions into the atmosphere.

While the invention has been shown in only one of its forms, it should be apparent that it is not thus limited but is susceptible to various changes and modifications without departing from the spirit thereof.

I claim:

1. A fuel treating device for improving the combustion characteristics of liquid fuels comprising:

a casing through which liquid fuel is adapted to flow;

an elongated metal bar located inside said casing for contacting said fuel flow;

said metal bar comprising an alloy of nickel, zinc, copper, tin, and silver.

2. The device of claim 1, wherein said elongated metal bar has a platinum coating on either end thereof.

3. A fuel treating device for improving the combustion characteristics of liquid fuels, comprising:

an elongated casing having a hollow interior and inlet and outlet ports for receiving and discharging fuel;

an elongated metal bar of generally triangular cross-sectional area located within and substantially occupying the hollow interior of said casing, said elongated bar having exterior surfaces in contact with said fuel being received and discharged through said casing ports;

the exterior surfaces of said elongated bar in contact with said fuel having spaced-apart elevated ridges for promoting turbulence in said fuel flowing through said casing;

said elongated metal bar comprising an alloy of nickel, zinc, copper, tin, and silver.

4. The device of claim 3, wherein said metal bar has a platinum coating on either end thereof.

5. The device of claim 4, wherein said alloy comprises 10–30 weight percent nickel, 15–40 weight percent zinc, 30–60 weight percent copper, 5–20 weight percent tin, and 1–10 weight percent silver, the weight percentages being based on the total weight of alloy present.

6. The device of claim 5, wherein said alloy comprises 21 weight percent nickel, 25 weight percent zinc, 42 weight percent copper, 10 weight percent tin and 2 weight percent silver, the weight percentages being based on the total weight of alloy present.

7. In a combustion process wherein liquid fuel and an oxygen-containing gas are first mixed and then ignited, a method of treating the fuel prior to mixing it with the gas, comprising the steps of:

flowing said fuel through a casing having a hollow interior in which is housed an elongated metal bar, said bar having exterior surfaces in contact with said fuel flow;

wherein said metal bar is an alloy of nickel, zinc, copper, tin, and silver.

8. The method of claim 7, wherein said metal bar has a platinum coating applied to either end thereof.

* * * * *